United States Patent [19]

Levasseur

[11] 3,998,357

[45] Dec. 21, 1976

[54] VENDING CONTROL SYSTEM

[75] Inventor: Joseph L. Levasseur, St. Louis, Mo.

[73] Assignee: Coin Acceptors, Inc., St. Louis, Mo.

[22] Filed: May 27, 1975

[21] Appl. No.: 581,202

[52] U.S. Cl. ..... 221/21; 221/129

[51] Int. Cl.[2] ..... G07F 11/36

[58] Field of Search ..... 221/21, 129

[56] References Cited

UNITED STATES PATENTS

| | | | |
|---|---|---|---|
| 2,250,086 | 7/1941 | Voigtritter | 221/21 X |
| 3,409,116 | 11/1968 | O'Malley | 221/21 X |
| 3,763,982 | 10/1973 | Glen | 221/21 X |

*Primary Examiner*—Robert B. Reeves
*Assistant Examiner*—Francis J. Bartuska
*Attorney, Agent, or Firm*—Cohn, Powell & Hind

[57] ABSTRACT

The vending control system has first and second motor- and dispensing- assemblies, each assembly including a motor for driving a load and dispensing a product, a motor cam switch connected to the motor, a load cam switch connected to the motor, a motor cam drivingly connected to the motor and operatively actuating the motor cam switch, a load cam operatively actuating the load cam switch, and a torque-limiting clutch interconnecting the cams for driving the load cam and for permitting relative rotational movement of the cams at predetermined torque value. The assemblies are connected in parallel, with the motor and load cam switch of each assembly connected across the power source. The motor cam switch of the first assembly is connected to the power source and to the motor cam switch of the second assembly. An actuator selectively energizes the motor of one of the assemblies through the associated load cam switch so that the motor cam of the selectively energized motor actuates its associated motor cam switch to operatively connect the motor to the power source, and so that the load cam of the selectively energized motor subsequently actuates its associated load cam switch to operatively disconnect the motor from the power source as the cams are drivingly rotated by the motor. The motor cam of the selectively energized motor actuates its motor cam switch to operatively disconnect the motor from the power source, and operatively connects the motor cam switch of the other assembly to the power source as the motor cam rotates relative to its associated load cam when the predetermined torque value of the clutch is exceeded upon jamming of the load cam.

4 Claims, 3 Drawing Figures

VENDING CONTROL SYSTEM

BACKGROUND OF THE INVENTION

This invention relates generally to improvements in a vending control system, and more particularly to a torque-limiting clutch assembly for such a vending control system to preclude overload or stalling of an electric motor should the product being dispensed by the motor jam the dispensing mechanism driven by the motor, to preclude usage of this disabled motor and complementary circuitry until the product jamming the vending dispensing mechanism has been removed, and to preclude the disabling of all other parallel-connected motors when one or more of such motors have been disabled by product jamming.

In a vending machine capable of dispensing one or more individual products, an electric motor-driven mechanism is required to physically dispense such products. A typical vending machine may consist of several electric motors and dispensing assemblies connected in parallel across a power source. In the heretofore conventional vending control systems, when the product being dispensed by a motor jams its dispensing mechanism driven by such motor, the electric motor can be overloaded or stalled. Moreover, in such systems, further damage to the electric motor and its complementary circuitry could be caused by attempted operation before the product jamming the vending dispensing mechanism has been removed. In addition, all of the parallel-connected motors of the assemblies would be disabled upon disabling of any one of such motors, thereby causing a complete shut-down of a vending machine.

SUMMARY OF THE INVENTION

This vending control system, in a vending machine capable of dispensing one or more individual products, precludes over-loading or stalling of an electric motor should the product being dispensed by the motor jam the dispensing mechanism driven by the motor, and precludes damage to the electric motor and its complementary circuitry that could be caused by attempted operation of the motor before the product jamming the vending dispensing mechanism has been removed. In a vending machine utilizing several electric motors and dispensing assemblies connected in parallel across a power source, this vending control system precludes a complete shut-down of the vending machine when any one of the motors is disabled by jamming of its associated dispensing mechanism, thereby enabling operation of all parallel-connected motors and the vending of their associated products even though one or more other parallel-connected motors are disabled.

The present vending control system includes a motor for driving a load such as a dispensing mechanism and products being dispensed by such mechanism, a motor cam switch connected to a power source and to the motor, and a load cam switch connected to the power source and to the motor. A motor cam is drivingly connected to the motor and operatively actuates the motor cam switch for normally disconnecting the motor from the power source. A load cam operatively actuates the load cam switch for normally connecting the motor to the power source. A torque-limiting clutch interconnects the cams for driving the load cam, and for permitting relative rotational movement of the cams at a predetermined torque value. The motor cam actuates the motor cam switch means to operatively connect the motor to the power source, and the load cam subsequently actuates the load cam switch to operatively disconnect the motor from the power source as the cams are drivingly rotated by the motor. When the predetermined torque value of the clutch is exceeded, upon jamming of the load cam, the motor cam rotates relative to the load cam and actuates the motor cam switch to operatively disconnect the motor from the power source.

The motor is initially energized by an actuating means through its associated load cam switch, the actuating means being reset for subsequent operation as the motor cam actuates the motor cam switch to connect the motor to the power source.

The actuating means includes a coin changer which is well known in the trade and to those skilled in the art operatively connected to the motor cam switch, and a coin changer-controlled means which is well known in the trade and to those skilled in the art operatively connected to the coin changer and operatively connected to a normally opened circuit condition to the load cam switch and to the power source. The coin changer-controlled means in a closed circuit condition energizes the motor through the load cam switch upon a signal from the coin changer. The coin changer is reset for subsequent operation, and the coin changer-controlled means is reset to the normally opened circuit condition as the motor cam switch is actuated by the motor cam to connect the motor to the power source The motor cam switch includes a normally closed contact, a normally opened contact, and a common contact actuated by the motor cam selectively into electrical action with either the normally closed contact or opened contact. The load cam switch includes a normally closed contact, and a common contact actuated by the load cam selectively into and out of electrical connection with the normally closed contact. The normally opened contact of the motor cam switch and the normally closed contact of the load cam switch are interconnected to each other and to the motor, and the respective common contacts are connected to the power source.

The coin changer is operatively connected to the normally closed contact of the motor cam switch, and the coin changer-controlled means is operatively connected to the coin changer and operatively connected in a normally opened circuit condition to the common contact of the load cam switch and to the power source. Disconnection of the common contact of the motor cam switch from its normally closed contact resets both the coin changer and the coin-changer controlled means for subsequent operation.

More particularly, the vending control system includes a first and a second motor-and-dispensing assembly, each of which includes a motor, a motor cam switch, a load cam switch, a motor cam, a load cam and a torque-limiting clutch operatively interconnected as described previously. The assemblies are connected in parallel by connecting the motor and load cam switch of each assembly across the power source. Moreover, the motor cam switch of the first assembly is connected to the power source and connected to the motor cam switch of the second assembly. The actuating means selectively energizes the motor of either one of the assemblies through its associated load cam switch. The motor cam of the selectively energized motor actuates its motor cam switch to operatively disconnect the motor from the power source and to operatively connect the motor cam switch of the other assembly to the power source as the motor cam rotates relative to its associated load cam when the predetermined torque value of the clutch is exceeded upon jamming of the load cam.

In this system utilizing a plurality of parallel-connected motor-and-dispensing assemblies, the actuated means is operatively connected to the motor cam switch of the second assembly and to the load cam switch of each assembly, the actuating means being reset for subsequent operation as the motor cam of the selectively energized motor actuates its associated motor cam switch to connect the motor to the power source.

DESCRIPTION OF THE PREFERRED EMBODIMENT

Figure 1:
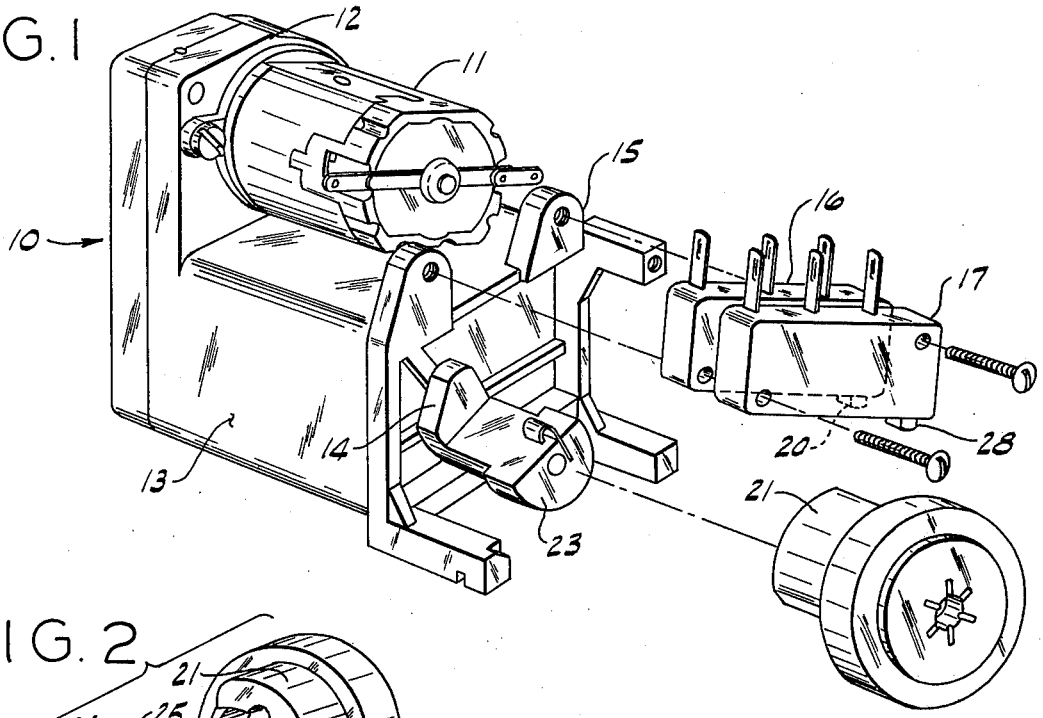
FIG. 1 is an exploded, perspective view of the motor and dispensing assembly.
Figure 2:
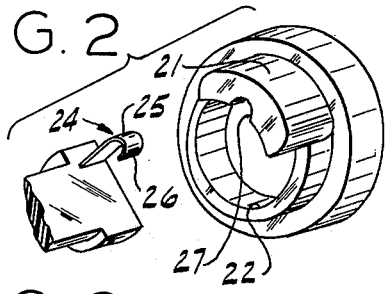
FIG. 2 is a perspective view of the torque-limiting clutch.

Referring now by characters of reference to the drawing, and first to FIGS. 1 and 2, the physical structure and arrangement of each motor-and-dispensing assembly 10 will be described. The assembly 10 includes a motor 11 secured to a motor mount 12 and operatively connected through a speed reducer 13 to a motor cam 14. Mounted on a bracket 15 of the speed reducer 13 and in front of the motor 11 is a motor cam switch 16 and a load cam switch 17. The motor cam 14 is adapted to engage and actuate the switch button 20 of the motor cam switch 16.

A load cam 21 is provided with a cylindrical recess defined by an internal cylindrical surface 22. The motor cam 14 includes an integral shaft portion 23 adapted to interfit the cylindrical recess of and support the load cam 21.

The motor cam 14 and the load cam 21 are operatively interconnected for rotation by a torque-limiting clutch generally indicated by 24, the clutch 24 including a leaf spring 25 attached to and carried by the motor cam shaft portion 23. This spring 25 includes an integral, arcuately shaped end 26. The inside of the load cam 21 is provided with a longitudinal, arcuately shaped groove 27 adapted to receive the compatibly shaped spring end 26 upon assembly of the cams 14 and 21.

When the motor cam 14 is drivingly rotated by the motor 11, the motor cam 14 will also drivingly rotate the load cam 21 by the inter-engagement of the spring end 26 in the groove 27. When a predetermined torque value is reached, as when the load cam 21 is retarded or held stationary, the spring end 26 will ride out of the groove 27 and engage the cylindrical surface 22, and permit relative rotation of the motor cam 14 and load cam 21. Then the load cam 21 is operatively connected to the motor cam 14 through the clutch 24, the load cam 21 is positioned to engage and actuate the switch button 28 of the load cam switch 17.

Figure 3:
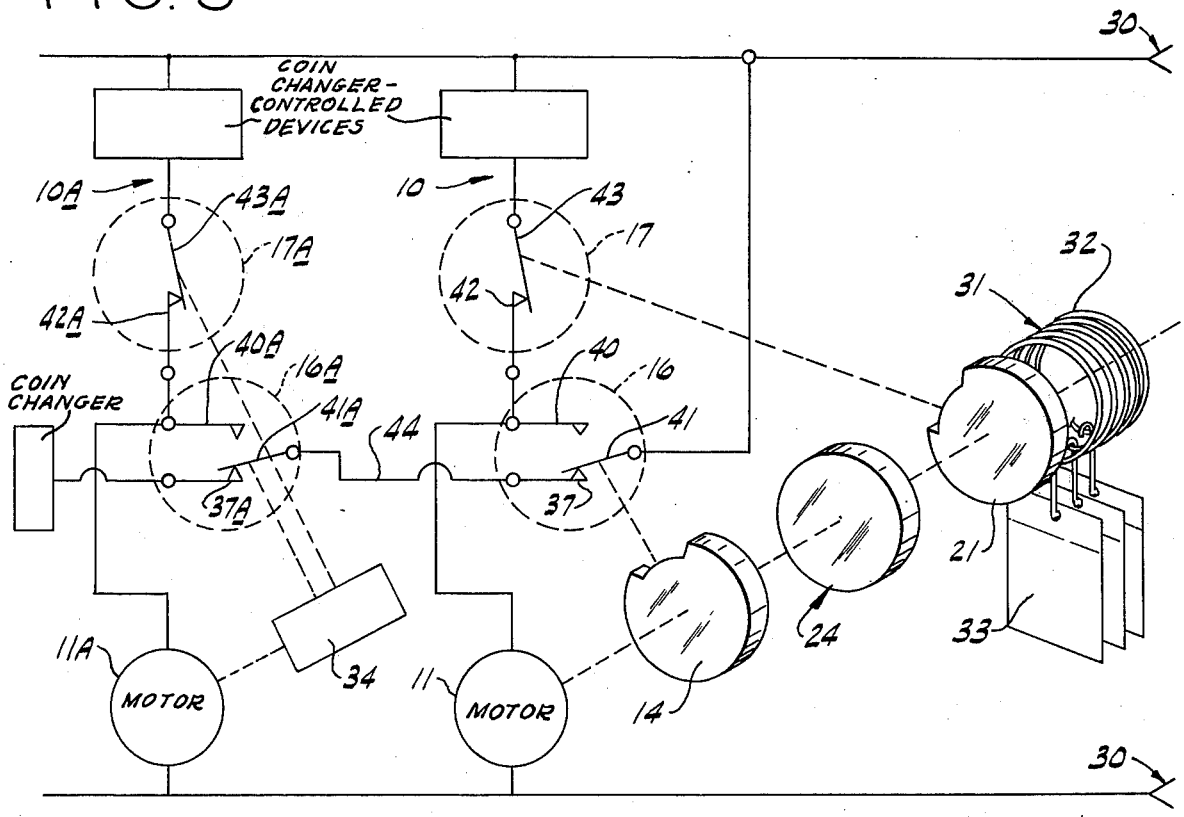
FIG. 3 is a circuit diagram of the vending control system.

The circuit diagram of FIG. 3 discloses an electrical power source 30. In the vending machine in which this vending control system is utilized, there are a plurality of motor-and-dispensing assemblies connected in parallel across the power source 30. For convenience and clarity, the component parts of one such assembly will be provided the same reference numerals as utilized in FIGS. 1 and 2, while another assembly will have the same reference numerals with the suffix A.

For example, in FIG. 3, the assembly 10 has the motor 11 electrically connected to the power source 30. The motor 11 drivingly rotates the motor cam 14 and the load cam 21 through the torque-limiting clutch 24. The load 31 operatively connected to and operated by the load cam 21 is represented by a dispensing mechanism such as a spiral wire 32, and a plurality of products 33 held by hooks on the spiral wire 32. As the load cam 21 rotates, the wire 32 will rotate and the products will be dispensed individually off of the wire 32 upon a complete rotation of the load cam 21 and wire 32.

In the assembly 10, the motor cam switch 16 and load cam switch 17 are each connected to the motor 11, and to the power souce 30. Specifically, the assemblies 10 and 10A are connected in parallel by connecting the respective motors 11–11A and load cam switches 17–17A across the power source 30. The motor cam switch 16 of the assembly 10 is connected to the power source 30, and is connected to the motor cam witch 16A of the other assembly 10A.

It will be understood that the cams and load operatively connected to the motor 11A of the assembly 10A are the same as that described previously with respect to assembly 10, but for simplicity are shown by the block diagram 34.

A coin changer and coin changer-controlled device are operatively connected to the motor cam switches 16–16A and to the load cam switches 17–17A so as to selectively energize the motor 11 or 11A of one of the assemblies 10 or 10A through its associated load cam switch 17 or 17A. The motor cam 14 of the selectively energized motor 11, assuming that the assembly 10 is energized, actuates the associated motor cam switch 16 to operatively connect the motor 11 to the power source 30. Upon continued operation of the motor 11, the load cam 21 of the selectively energized motor 11 subsequently actuates the associated load cam switch 17 to operatively disconnect the motor 11 from the power source as the cams 14–21 are drivingly rotated. The coin changer and coin changer-controlled device are reset for subsequent operation as the motor cam 14 of the selectively energized motor 11 actuates its associated motor cam switch 16 in connecting the motor 11 to the power source 30. Upon a complete rotation of the cams 14–21, the product 33 will be dispensed from the spiral wire 32.

If during energization of the motor 11 and rotation of the cams 14–21, the load 31 jams the load cam 21 so as to preclude rotation of the load cam 21, the clutch 24 will enable continued rotation of the motor cam 14 when the predetermined torque value of the clutch 24 is exceeded. The motor cam 14 will then actuate its motor cam switch 16 to operatively disconnect the motor 11 from the power source 30, and will operatively connect the motor cam switch 16A of the other assembly 10A to the power source 30. Because the load switch 17 is maintained in an opened circuit condition, the motor 11 of assembly 10 cannot be energized until the load 31 is unjammed and the cams 14–21 repositioned relative to each other and operatively interconnected by the clutch 24. However, because the motor switch 16A of the other assembly 10A is reconnected to the power source 30 by the closed circuit condition of the motor cam switch 16 of assembly 10, the motor 11A of assembly 10A can be subsequently selectively energized for dispensing a product even though the motor 11 is disabled.

Each motor cam switch 16 includes a normally closed contact 37, a normally opened contact 40, and a common contact 41 actuated by the motor cam 14 selectively into electrical connection with either of the contacts 37 and 40.

The load cam switch 17 includes a normally closed contact 42 and a common contact 43 actuated by the load cam 21 selectively into and out of electrical connection with the contact 42. The normally opened contact 40 of the motor cam switch 16 and the normally closed contact 42 of the load cam switch 17 are interconnected to each other and to the motor 11.

The coin changer is operatively connected to the normally closed contact 37A of the motor cam switch 16A of assembly 10A. The coin changer is also operatively connected to the motor cam switch 16 of the assembly 10 because the common contact 41A of motor cam switch 16A is connected to the normally closed contact 37 of motor cam switch 16. The common contact 41 of this motor cam switch 16 is connected to the power source 30.

The coin changer-controlled devices are operatively connected respectively to the load cam switch 17 and 17A of the assemblies 10 and 10A. More particularly, the coin changer-controlled device of assembly 10A, for example, is operatively connected to the coin changer and is operatively connected in a normally opened circuit condition to the common contact 43 of the load cam switch 17 and to the power source 30. The coin changer-controlled device is actuated to a closed circuit condition upon a signal from the coin changer to energize the motor 11.

It will be assumed that the user of the vending machine desires to dispense a product 33 which involves the energization of motor 11 of assembly 10. It will also be understood that if a product dispensed by motor 11A of assembly 10A was desired, the operation would be the same as that now described.

After the coin changer has received the appropriate amount of money and a selection is made, the coin changer-controlled device is conditioned upon a signal from the coin changer to complete the circuit to the electric motor 11 through the normally closed contacts 42 and 43 of the load cam switch 17. The motor 11 is now energized to the power source 30. The motor 11 rotatively drives the motor cam 14, clutch 24, load cam 21 and load 31 simultaneously and with no relative angular displacement therebetween.

Upon rotation of the motor cam 14, the first event that happens is that the common contact 41 transfers from the low lobe of motor cam 14 to the high lobe to separate the common contact 41 from the normally closed contact 37, and moves the contact 41 into engagement with the normally opened contact 40, whereby to place the motor 11 into operative connection with the power source 30 through a circuit parallel to the one formed by the coin changer-controlled device and the normally closed contacts 43 and 42 of the load cam switch 17.

Upon separation of the common contact 41 and the contact 37 of the motor cam switch 16, the coin changer is signaled that a vend cycle has been initiated and resets the changer through the reset signal circuit 44 to a state of readiness for the next sale as soon as the one in process has been completed. In addition, the coin-changer-controlled device is reset at the same time by a signal from the coin changer to an opened circuit condition.

Upon continued rotation of the cams 14 and 21, the second event to happen is that the common contact 43 of the load cam switch 17 transfers from the low lobe of load cam 21 to the high lobe and thereby disconnects the contacts 43 and 42 of the load cam switch 17. This event occurs immediately after the previously described first event. Even though the load cam switch 17 is in an opened circuit condition, the motor 11 is energized and running because the contacts 41 and 40 of the motor cam switch 17 are closed. As the cams 14 and 21 continue to rotate, the spiral wire 32 moves the product 33 toward delivery. Some time near the end of the 360 degree cam rotation, the product 33 is finally delivered by disengagement from the wire 32.

After the delivery of product 33, the last event to happen is that the contacts 43 and 42 of the load cam switch 17 are closed and the contacts 41 and 37 of the motor cam switch 16 are again closed, thereby de-energizing the motor 11. This last event can happen simultaneously as the control of the switches 16 and 17 changes from the high lobes to the low lobes of the respective cams 14 and 21. When the motor stops, the vend cycle is complete.

If the load 31 is in some way jammed after the motor 11 is energized and after the contacts 41 and 40 of the motor cam switch 16 are closed by the motor cam 14, and the contacts 43 and 42 of the load cam switch 17 are opened by the associated load cam 21, relative rotational movement of the cams 14 and 21 is permitted. For example, with the load 31 and the load cam 21 trying to stop, the torque-limiting clutch 24 reaches its set torque value and disengages effectively the load 31 and load cam 21 from the motor 11 and motor cam 14. With the clutch 24 disengaged, the dispensing wire 32 and the load cam 21 stop rotating. Because the load cam switch 17 is controlled by the high lobe of the load cam 21, the contacts 43 and 42 of the load cam switch 17 are maintained in an opened circuit condition.

However, the motor 11 is still energized and is rotating the motor cam 14. This motor cam 14 then completes a 360°rotation and causes a re-engagement of the contacts 37 and 41 of the motor cam switch 16 as described previously to effect a de-energization of the motor 11.

Because of the jamming on the load side of the torque-limiting clutch 24, the contacts 43 and 42 of the load cam switch 17 are maintained in an opened circuit condition, and therefore the motor 11 and the complementary circuitry cannot be used again until the jamming is cleared and the load cam 21 angularly reset to its starting position relative to the motor cam 14 and the clutch 24.

However, it will be importantly understood that because of the torque-limiting clutch 24, the motor cam switch 16 was reset to its normally closed condition, and consequently the other motor 11A of the other assembly 10A and its complementary circuitry were not disabled and can be operated even though motor 11 cannot be operated.

I claim as my invention:

1. In a vending control system, comprising:

a. an electrical power source, b. a motor for driving a load, c. a motor cam switch means connected to the power source and to the motor, d. a load cam switch means connected to the power source and to the motor, e. a motor cam drivingly connected to the motor and operatively actuating the motor cam switch means for normally disconnecting the motor from the power source, f. a load cam operatively actuating the load cam switch means for normally connecting the motor to the power source, the load cam being operatively connected to the load, g. a torque-limiting clutch means interconnecting the cams for driving the load cam and for permitting relative rotational movement of the cams at a predetermined torque value, and h. the motor cam actuating the motor cam switch means to operatively connect the motor to the power source, and the load cam subsequently actuating the load cam switch means to operatively disconnect the motor from the power source as the cams are drivingly rotated by the motor, and the motor cam actuating the motor cam switch means to operatively disconnect the motor completely from the power source as the motor cam rotates relative to the load cam when the predetermined torque value of the clutch means is exceeded upon jamming of the load cam.

2. A vending control system as defined in claim 1, in which:

i. the motor cam switch means includes a normally closed contact, a normally opened contact, and a common contact actuated by the motor cam selectively into electrical connection with either the said normally closed or opened contacts, j. the load cam switch means includes a normally closed contact and a common contact actuated by the load cam selectively into and out of electrical connection with the normally closed contact, and k. the normally opened contact of the motor cam switch means and the normally closed contact of the load cam switch means being interconnected to each other and to the motor, and the common contacts being connected to the power source, the motor cam moving the common contact of the motor cam switch means into electrical connection with the normally closed contact, and the load cam moving the common contact of the load cam switch means out of electrical connection with the normally closed contact to completely disconnect the motor from the power source upon jamming of the load cam.

3. In a vending control system, comprising:

a. an electrical power source, b. a first and a second motor-and-dispensing assembly, each assembly including:

1. a motor for driving a load, 2. a motor cam switch means connected to the motor, 3. a load cam switch means connected to the motor, 4. a motor cam drivingly connected to the motor and operatively actuating the motor cam switch means, 5. a load cam operatively actuating the load cam switch means, the load cam being operatively connected to the load, 6. a torque-limiting clutch means interconnecting the cams for driving the load cam and for permitting relative rotational movement of the cams at a predetermined torque value, c. the assemblies being connected in parallel by connecting the motor and load cam switch means of each assembly across the power source, d. the motor cam switch means of the first assembly being connected to the power source and to the motor cam switch means of the second assembly, e. the motor cam of the selectively energized motor actuating its associated motor can switch means to operatively connect the motor to the power source, and the load cam of the selectively energized motor subsequently actuating its associated load cam switch means to operatively disconnect the motor from the power source as the cams are drivingly rotated by the motor, and f. the motor cam of the selectively energized motor actuating its motor cam switch means to operatively disconnect the motor completely from the power source and to operatively connect the motor cam switch means of the other assembly to the power source as the motor cam rotates relative to its associated load cam when the predetermined torque value of the clutch means is exceeded upon jamming of the load cam.

4. A vending control system as defined in claim 3, in which:

g. each motor cam switch means includes a normally closed contact, a normally opened contact and a common contact actuated by its associated motor cam selectively into electrical connection with either of the said normally closed and opened contacts, h. each load cam switch means includes a normally closed contact and a common contact actuated by its associated load cam selectively into and out of electrical connection with the normally closed contact, and i. the normally opened contact of each motor cam switch means and the normally closed contact of its associated load cam switch means being interconnected to each other and to the associated motor, and the common contacts of each motor cam switch means and each load cam switch means being connected to the power source, the motor cam of the selectively energized motor moving the common contact of its motor cam switch means into electrical connection with the normally closed contact, and the load cam moving the common contact of its load cam switch means out of electrical connection with the normally closed contact to completely disconnect the motor from the power source upon jamming of the load cam and yet electrically connect the motor cam switch means of the other motor to the power source.

* * * * *